US010366815B2

(12) United States Patent
Diao

(10) Patent No.: US 10,366,815 B2
(45) Date of Patent: Jul. 30, 2019

(54) PERMANENT MAGNET DRIVE ON-LOAD TAP-CHANGING SWITCH

(71) Applicant: Junqi Diao, Jinan (CN)

(72) Inventor: Junqi Diao, Jinan (CN)

( * ) Notice: Subject to any disclaimer, the term of this patent is extended or adjusted under 35 U.S.C. 154(b) by 21 days.

(21) Appl. No.: 15/540,652

(22) PCT Filed: Jan. 28, 2015

(86) PCT No.: PCT/CN2015/071723
§ 371 (c)(1),
(2) Date: Jun. 29, 2017

(87) PCT Pub. No.: WO2016/106931
PCT Pub. Date: Jul. 7, 2016

(65) Prior Publication Data

US 2018/0019044 A1 Jan. 18, 2018

(30) Foreign Application Priority Data

Dec. 29, 2014 (CN) ..... 2014 1 0831993

(51) Int. Cl.
*H01F 7/02* (2006.01)
*H01H 1/56* (2006.01)
(Continued)

(52) U.S. Cl.
CPC ..... *H01F 7/0242* (2013.01); *H01F 29/04* (2013.01); *H01H 1/48* (2013.01); *H01H 1/56* (2013.01); *H01H 3/28* (2013.01)

(58) Field of Classification Search
CPC .. H01H 1/56; H01H 1/48; H01H 3/28; H01H 9/0016; H01F 29/04; H01F 7/0242
(Continued)

(56) References Cited

U.S. PATENT DOCUMENTS 2,447,634 A * 8/1948 Carlin ..... G05F 1/147 318/447
3,112,438 A * 11/1963 Buhler ..... H01F 29/04 323/341
2014/0167529 A1* 6/2014 Teising ..... H01H 9/0027 307/134

FOREIGN PATENT DOCUMENTS

CN 2205054 Y 8/1995
CN 201117561 Y 9/2008
(Continued)

OTHER PUBLICATIONS

Sep. 30, 2015 Search Report issued in International Patent Application No. PCT/CN2015/071723.
(Continued)

*Primary Examiner* — Shawki S Ismail
*Assistant Examiner* — Lisa N Homza
(74) *Attorney, Agent, or Firm* — Oliff PLC

(57) ABSTRACT

A permanent magnet drive on-load tap-changing switch including a changing switch circuit that includes an odd- and an even-numbered tap-changing circuit that are structurally identical. The tap-changing circuits include working contactors and dual-contact synchronous transition contactors made of primary contactors and secondary contactors. The working contactors and the dual-contact synchronous transition contactors directly face moving contactors. The moving contactors are connected in parallel to each other. Moving contactor permanent magnets are bijectively connected onto the moving contactors. The moving contactor permanent magnets directly face on the other extremity thereof a moving contactor driving mechanism. The moving contactor driving mechanism moves the permanent magnets. The switch is structurally simple and convenient to use, obviates the need for a highspeed mechanism, implements changing by direct actions of the contactors, operates at high
(Continued)

speed and reliably, has a low failure rate, an extended service life, and value for widespread use.

3 Claims, 3 Drawing Sheets

(51) Int. Cl.
*H01F 29/04* (2006.01)
*H01H 1/48* (2006.01)
*H01H 3/28* (2006.01)

(58) Field of Classification Search
USPC ..... 335/302, 121; 307/112
See application file for complete search history.

(56) References Cited

FOREIGN PATENT DOCUMENTS

| | | | |
|---|---|---|---|
| CN | 201397763 | Y | 2/2010 |
| CN | 101669182 | A | 3/2010 |
| CN | 203119860 | U | 8/2013 |
| CN | 104081479 | A | 10/2014 |
| CN | 204270897 | U | 4/2015 |
| DE | 102012007075 | A1 | 10/2013 |
| WO | 2006/087401 | A1 | 8/2006 |

OTHER PUBLICATIONS

Sep. 30, 2015 Written Opinion issued in International Patent Application No. PCT/CN2015/071723.
Mar. 14, 2016 Office Action issued is Chinese Patent Application No. 201410831993.7.

* cited by examiner

PERMANENT MAGNET DRIVE ON-LOAD TAP-CHANGING SWITCH

TECHNICAL FIELD

The present invention relates to an on-load tap-changing switch, in particular to a permanent magnet drive on-load tap-changing switch.

BACKGROUND ART

A transformer is switched from one tap to another tap to change the number of turns of an active coil of the transformer at the high-voltage side to achieve the purpose of voltage regulation. An on-load tap-changing switch changes load current by virtue of a changing switch; the highspeed mechanism is a power source of the changing switch. At present, the highspeed mechanism is mainly a spring energy release device; however, a spring has poor reliability; complete paralysis will be caused once a main spring is damaged; and with the increase of use time, the elasticity of the spring will get worse and worse or broken, and that will result in serious results.

SUMMARY OF THE INVENTION

For the above problem, the present invention provides a permanent magnet drive on-load tap-changing switch which obviates the need for a highspeed mechanism, uses the contactors to act directly, operates at high speed and reliably, has an extended service life.

In order to solve the above problem, the present invention adopts the following technical solution: a permanent magnet drive on-load tap-changing switch comprising a changing switch circuit. The changing switch circuit comprises an odd-numbered tap-changing circuit and an even-numbered tap-changing circuit that are structurally identical. The tap-changing circuits comprise working contactors and dual-contact synchronous transition contactors consisting of primary contactors and secondary contactors. The working contactors are connected to the primary contactors through trigger transmitters and transition resistors; the primary contactor of a tap-changing circuit is connected to the secondary contactor of another tap-changing circuit through a high-voltage thyristor; the trigger transmitter is configured to provide a trigger current to the high-voltage thyristor connected with the secondary contactor of the same tap-changing circuit. The working contactors and the dual-contact synchronous transition contactors directly face moving contactors. The moving contactors are connected in parallel to each other. Moving contactor permanent magnets are bijectively connected onto the moving contactors. The moving contactor permanent magnets directly face on the other extremity thereof a moving contactor driving mechanism. The moving contactor driving mechanism comprises a moving permanent magnet which moves to change the force acting on the moving contactor permanent magnets to allow the moving contactors to get contact with or depart from the working contactors and the dual-contact synchronous transition contactors. By changing the acting force of the moving permanent magnet on the permanent magnets via the moving permanent magnet, the moving contactors therefore get contact with or depart from the working contactors and the dual-contact synchronous transition contactors. When the moving permanent magnet gets close to the like pole of a moving contactor permanent magnet, the moving permanent magnet is repulsive to the moving contactor permanent magnet, and the moving contactors are in contact with the working contacts/double-contact synchronous transition contactors; when the moving permanent magnet is close to the unlike pole of the permanent magnet, the rotating permanent magnet attracts the permanent magnet, and the moving contactors depart from the working contacts/double-contact synchronous transition contactors.

The moving permanent magnet is composed of a plurality of permanent magnets which are arranged side by side at intervals and the same ends of every two adjacent permanent magnets have unlike poles.

In order to facilitate the design and manufacturing of the moving permanent magnet and make the force acting on the moving contactor permanent magnets easily adjusted, and the moving contactors are connected to the like pole ends of the moving contactor permanent magnets, and the pole ends of the moving contactor permanent magnets, facing the moving contactor driving mechanism, are defined as like pole ends.

The present invention is structurally simple and convenient to use, obviates the need for a highspeed mechanism, implements changing by means of direct actions of the contactors, operates at high speed and reliably, has a low failure rate, an extended service life, and value for widespread use.

Wherein, 1. moving contactor; 2. moving contactor permanent magnet; 3. moving permanent magnet D1-D4 are moving contactors; K1 and K2 are working contactors; R1 and R2 are transition resistors; k1, k1' and k2, k2' are double-contact synchronous transition contactors, where k1 and k2 are primary contactors; k1' and k2' are secondary contactors; TSCB1 and TSCB2 are trigger transmitters; TSC1 and TSC2 are high-voltage thyristors.

DETAILED DESCRIPTION OF THE PREFERRED EMBODIMENTS

Embodiment 1

A permanent magnet drive on-load tap-changing switch, as shown in FIGS. 1-5, comprising a permanent magnet changing switch circuit. The permanent magnet changing switch circuit comprises an odd-numbered tap-changing circuit and an even-numbered tap-changing circuit that are structurally identical. The tap-changing circuits comprise working contactors K1/K2 and dual-contact synchronous transition contactors k1, k1'/k2, k2' consisting of primary contactors k1/k2 and secondary contactors k1'/k2'. The working contactors K1/K2 are connected to the primary contactors k1/k2 through trigger transmitters TSCB1/TSCB2 and transition resistors R1/R2; the primary contactors k1 of the odd-numbered tap-changing circuit are connected to the secondary contactors k2' of the even-numbered tap-changing circuit through a high-voltage thyristor TSC2; the primary contactors k2 of the even-numbered tap-changing circuit are connected to the secondary contactors k1 of the even-numbered tap-changing circuit through a high-voltage thyristor TSC1. The trigger transmitter TSCB1 provides a trigger current for the high-voltage thyristor TSC1; the trigger transmitter TSCB2 provides a trigger current for the high-voltage thyristor TSC2. The working contactors K1/K2 and the dual-contact synchronous transition contactors k1, k1'/k2, k2' directly face a moving contactor 1. The moving contactors 1 are connected in parallel to each other. The moving contactors 1 are connected to the like pole ends of the moving contactor permanent magnets 2, and the moving contactor permanent magnets 2 directly face on the other extremity (like pole end) thereof a moving contactor driving mechanism. The moving contactor driving mechanism comprises a moving permanent magnet 3 which moves to change the force acting on the moving contactor permanent magnets 2 to allow the moving contactors 1 to get contact with or depart from the working contactors K1/K2 and the dual-contact synchronous transition contactors k1, k1'/k2, k2'. The moving permanent magnet 3 is composed of a plurality of permanent magnets which are arranged side by side at intervals and the same ends of every two adjacent permanent magnets have unlike poles.

Figure 1:
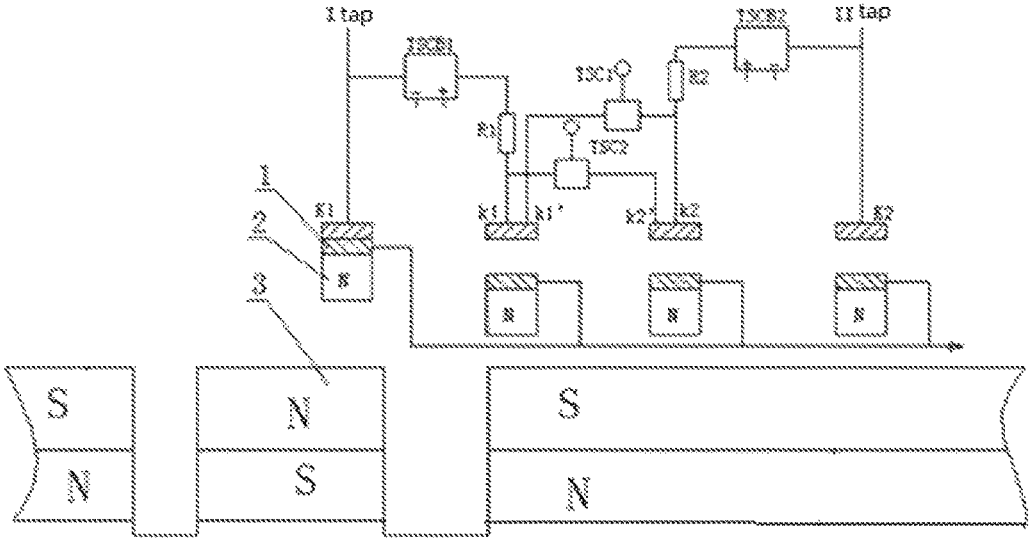
FIG. 1 is a schematic diagram of the present application where the moving contactors D1 and working contactors K1 are in contact.

As shown in FIGS. 1-5, the process that the moving contactors 1 are switched from working contactors K1 to working contactors K2 is shown as below:

As shown in FIG. 1, the moving contactors D1 are in contact with working contactors K1, and the trigger transmitters TSCB1 and TSCB2 have no current.

Figure 2:
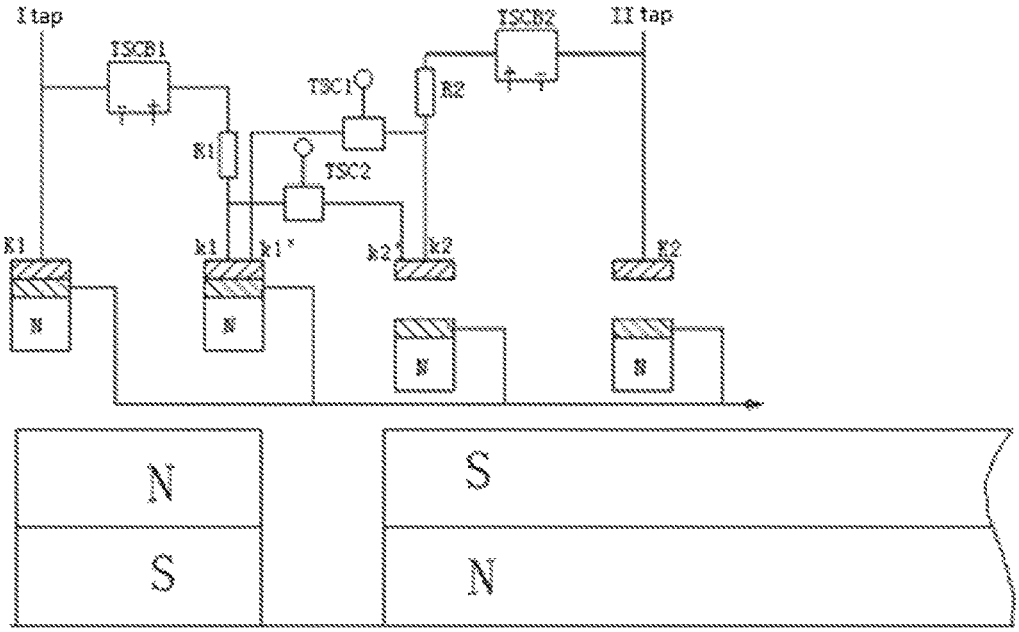
FIG. 2 is a schematic diagram of the present application where the moving contactors D1 and working contactors K1 are in contact and the moving contactors D2 and the double-contact synchronous transition contactors k1, k1' are in contact.

As shown in FIG. 2, the moving contactors D1 are in contact with working contactors K1, the moving contactors D2 are in contact with dual-contact synchronous transition contactors k1, k1', and the trigger transmitters TSCB1 and TSCB2 have no current.

Figure 3:
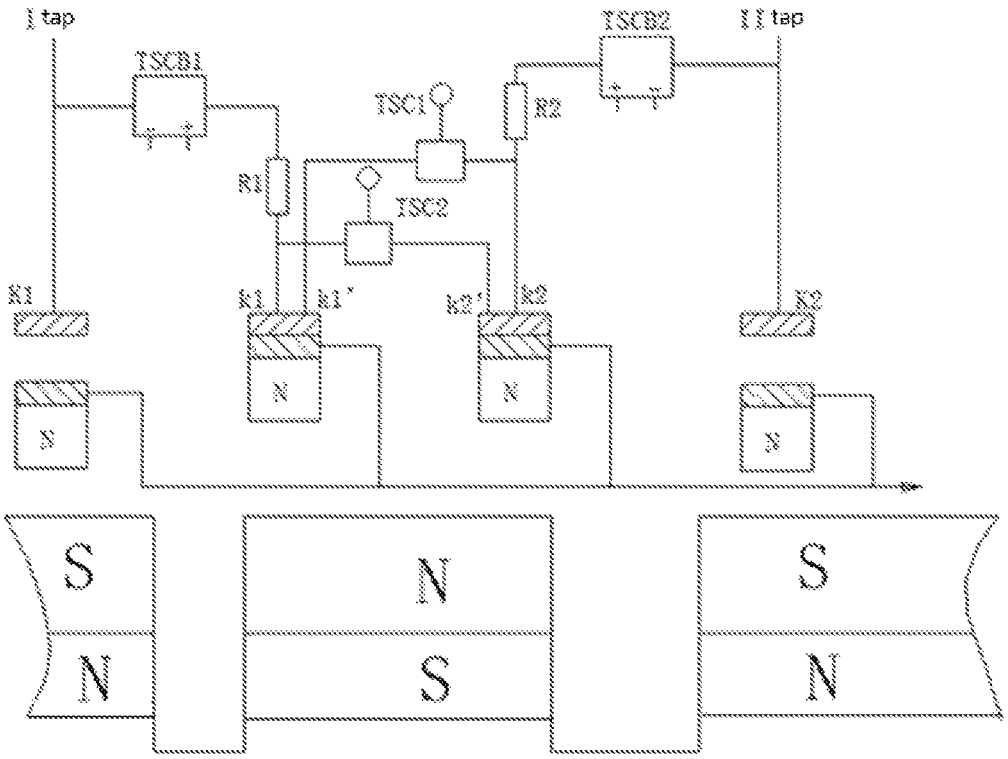
FIG. 3 is a schematic diagram of the present application where the moving contactors D2 and the double-contact synchronous transition contactors k1, k1' are in contact and the moving contactors D3 and the double-contact synchronous transition contactors k2, k2' are in contact.

As shown in FIG. 3, the moving contactors D2 are in contact with dual-contact synchronous transition contactors k1, k1', the moving contactors D3 are in contact with dual-contact synchronous transition contactors k2, k2', and the trigger transmitters TSCB1 and TSCB2 have current and are most likely to generate an electric arc.

Figure 4:
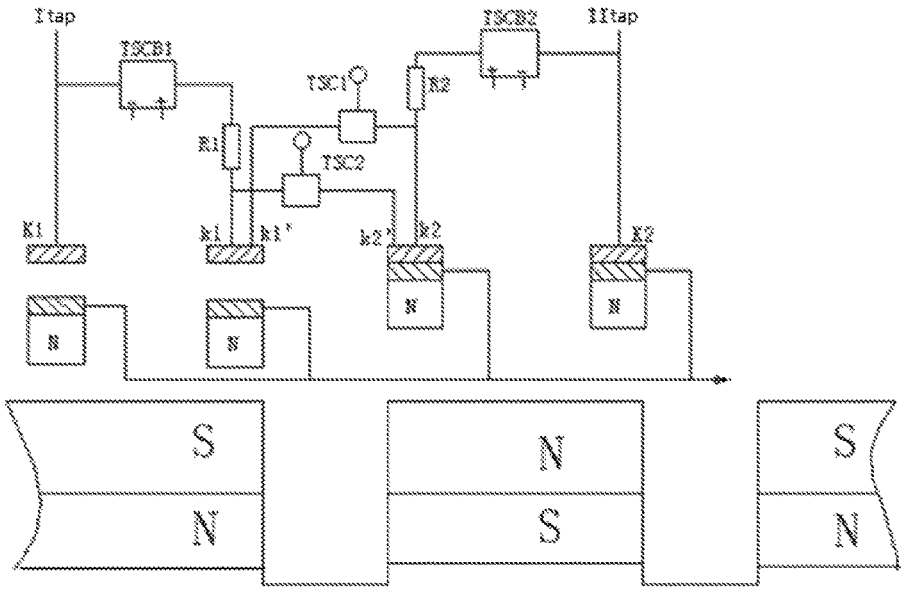
FIG. 4 is a schematic diagram of the present application where the moving contactors D3 and the double-contact synchronous transition contactors k2, k2' are in contact and the moving contactors D4 and the working contactors K2 are in contact.

As shown in FIG. 4, the moving contactors D4 are in contact with working contactors K2, the moving contactors D3 are in contact with dual-contact synchronous transition contactors k2, k2', and the trigger transmitters TSCB1 and TSCB2 have no current.

Figure 5:
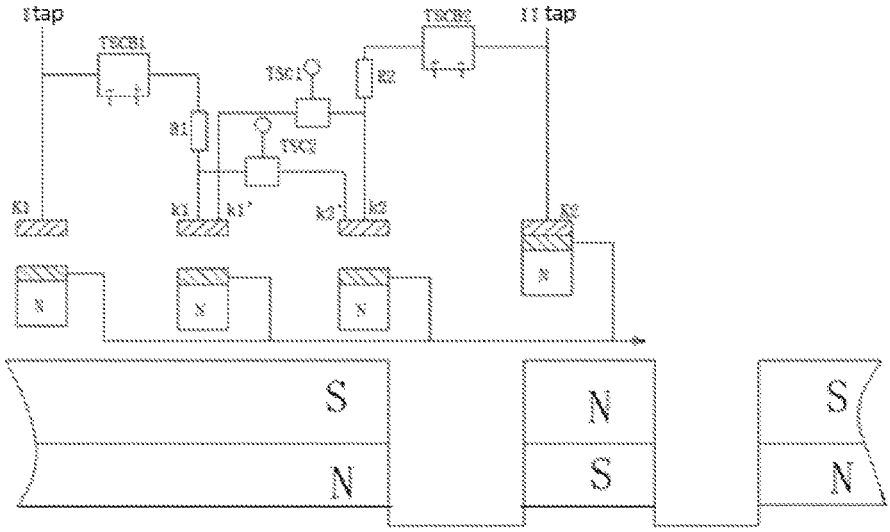
FIG. 5 is a schematic diagram of the present application where the moving contactors D4 and working contactors K2 are in contact.

As shown in FIG. 5, the moving contactors D4 are in contact with working contactors K2, and the trigger transmitters TSCB1 and TSCB2 have no current.

Normal working can be ensured without timely overhaul in the case of following faults:

(1) when the high-voltage thyristor TSC1 is open, the working contactors K1 and K2 have arc starting and arc extinction;

(2) when the high-voltage thyristor TSC2 is open, the working contactors K1 and K2 have arc starting and arc extinction;

(3) when the high-voltage thyristor TSC1 is closed, the dual-contact synchronous transition contactors k1, k1' have arc starting and arc extinction; and (4) when the high-voltage thyristor TSC2 is closed, the dual-contact synchronous transition contactors k2, k2' have arc starting and arc extinction.

The invention claimed is:

1. A permanent magnet drive on-load tap-changing switch, comprising:

a changing switch circuit, the changing switch circuit comprising an odd-numbered tap-changing circuit and an even-numbered tap-changing circuit that are structurally identical;

the odd-numbered tap-changing circuit and the even-numbered tap-changing circuit comprising working contactors and dual-contact synchronous transition contactors consisting of primary contactors and secondary contactors;

the working contactors being connected to the primary contactors through trigger transmitters and transition resistors;

a primary contactor of a tap-changing circuit being connected to a secondary contactor of another tap-changing circuit through a high-voltage thyristor;

a trigger transmitter being configured to provide a trigger current to the high-voltage thyristor connected with the secondary contactor of a same tap-changing circuit, wherein:

the working contactors and the dual-contact synchronous transition contactors directly face moving contactors;

the moving contactors are connected in parallel to each other;

moving contactor permanent magnets are bijectively connected to the moving contactors;

the moving contactor permanent magnets directly face, on an other extremity thereof, a moving contactor driving mechanism, the moving contactor driving mechanism comprising a moving permanent magnet which moves to change a force acting on the moving contactor permanent magnets to allow the moving contactors to get contact with or depart from the working contactors and the dual-contact synchronous transition contactors.

2. The permanent magnet drive on-load tap-changing switch according to claim 1, wherein:

the moving permanent magnet is composed of a plurality of permanent magnets which are arranged side by side at intervals; and same ends of every two adjacent permanent magnets have unlike poles.

3. The permanent magnet drive on-load tap-changing switch according to claim 1, wherein:

the moving contactors are connected to like pole ends of the moving contactor permanent magnets, the like pole ends being defined as pole ends of the moving contactor permanent magnets that face the moving contactor driving mechanism.

* * * * *